US005246119A

United States Patent [19]

Heffner

[11] Patent Number: 5,246,119

[45] Date of Patent: Sep. 21, 1993

[54] CUSTOMIZED ARRANGEMENT FOR PRESORTING RECYCLABLE MATERIALS

[76] Inventor: Keith A. Heffner, Rte. 1, Box 458-C, Hoopaugh Ave., Ellenboro, N.C. 28040

[21] Appl. No.: 802,378

[22] Filed: Dec. 4, 1991

[51] Int. Cl.[5] ..... B07C 7/04

[52] U.S. Cl. ..... 209/702; 220/404; 220/909

[58] Field of Search ..... 209/702; 220/404, 500, 220/909

[56] References Cited

U.S. PATENT DOCUMENTS

| | | | |
|---|---|---|---|
| 4,299,324 | 11/1981 | Dickens | 206/170 |
| 4,750,638 | 6/1988 | Sosower | 220/404 |
| 4,750,639 | 6/1988 | Schaerer | 220/410 |
| 4,834,253 | 5/1989 | Crine . | |
| 4,874,111 | 10/1989 | Heller | 220/500 |
| 4,905,853 | 3/1990 | Strawder | 220/404 |
| 4,940,159 | 7/1990 | Callas et al. | 220/404 |
| 4,960,220 | 10/1990 | Foa | 220/23.83 |
| 4,967,900 | 11/1990 | Gossett | 220/500 |
| 4,974,746 | 12/1990 | Dickinson | 209/702 |
| 4,978,018 | 12/1990 | Wood . | |
| 5,018,876 | 5/1991 | Mennella | 383/1 |
| 5,085,342 | 2/1992 | Strawder | 220/404 |
| 5,096,086 | 3/1992 | Crema | 220/909 |
| 5,101,997 | 4/1992 | Bagwell et al. | 220/909 |
| 5,119,957 | 6/1992 | Joyce-Middaugh | 220/404 |
| 5,119,958 | 6/1992 | Gabert et al. | 220/404 |
| 5,127,538 | 7/1992 | Bach | 220/404 |
| 5,129,543 | 7/1992 | White | 220/909 |
| 5,160,062 | 11/1992 | Strawder | 220/404 |
| 5,188,254 | 2/1993 | Evans | 220/404 |
| 5,190,183 | 3/1993 | McNaughton et al. | 220/404 |
| 5,193,713 | 3/1993 | Greathouse et al. | 220/404 |

FOREIGN PATENT DOCUMENTS

| | | | |
|---|---|---|---|
| 92164 | 10/1983 | European Pat. Off. | 209/702 |
| 15884 | of 1889 | United Kingdom | 220/500 |

*Primary Examiner*—Robert P. Olszewski
*Assistant Examiner*—Steven M. Reiss
*Attorney, Agent, or Firm*—Foley & Lardner

[57] ABSTRACT

An arrangement for presorting recyclable materials includes a first sector-shaped plastic bag having a first opening, a second sector-shaped plastic bag having a second opening, and a third sector-shaped plastic bag having a third opening. A first connector connects the first sector-shaped plastic bag to the second sector-shaped plastic bag near the first and second openings such that the second sector-shaped plastic bag can be disconnected from the first sector-shaped plastic bag to allow connection of a fourth sector-shaped plastic bag (that is identical to the second sector-shaped plastic bag) to the first sector-shaped plastic bag without having to remove the first sector-shaped plastic bag. A second connector connects the second sector-shaped plastic bag to the third sector-shaped plastic bag near the second and third openings such that the second sector-shaped plastic bag can be disconnected from the third sector-shaped plastic bag to allow connection of the fourth sector-shaped plastic bag to the third sector-shaped plastic bag without having to remove the third sector-shaped plastic bag.

32 Claims, 8 Drawing Sheets

CUSTOMIZED ARRANGEMENT FOR PRESORTING RECYCLABLE MATERIALS

BACKGROUND OF THE INVENTION

The invention is directed to an arrangement for presorting recyclable materials. More specifically, the invention is directed to a customized arrangement of plastic bags for presorting recyclable materials.

In recent years, the need to recycle materials has become more evident. Recycling conserves energy, reduces the need for landfills, and minimizes pollution.

It is desirable to presort recyclable materials as they are being initially disposed of to make subsequent recycling and recovery processes easier. For example, it is preferable that each household presort its various recyclable materials, such as different colored glass, metals, and the like, rather than attempt to sort out the various materials at a later time.

Several arrangements have been developed for presorting materials. For example, U.S. Pat. No. 4,750,639, issued to Schaerer on Jun. 14, 1988, discloses an arrangement for presorting garbage. This arrangement provides sectional sacks which form separate compartments. Each of the separate compartments can be used for sorting different types of recyclable materials. For example, one compartment can be used to store green glass, another compartment can be used to store brown glass, and a third compartment can be used to store metals.

The arrangement disclosed in the '639 patent is advantageous in that the arrangement takes advantage of the convenience of lightweight plastic garbage sacks to store various recyclable materials.

Unfortunately, a significant problem with presorting recyclable materials is that the various materials accumulate at different rates. In the '639 patent and other conventional arrangements, once one of the individual sectional sacks becomes filled, all of the sectional sacks have to be removed and disposed of—even though only one of the sectional sacks is full.

Another disadvantage of conventional arrangements is that conventional arrangements do not allow the user flexibility to customize the arrangement to his or her particular needs. That is, conventional arrangements do not allow the user to select the size of the compartments for storing the various recyclable materials.

SUMMARY OF THE INVENTION

It is an object of the invention, therefore, to provide an arrangement for presorting recyclable materials which allows individual compartments to be removed and replaced without having to replace the entire arrangement.

It is another object of the invention to provide an arrangement for presorting recyclable materials which allows a user to customize the size of the compartments for his or her particular needs.

Yet another object of the invention is to provide an arrangement for presorting recyclable materials which allows the contents of a closed bag containing recyclable materials to be readily identified.

Another object of the invention is to provide an arrangement for presorting recyclable materials which does not leave space between the various compartments.

According to a first aspect of the invention there is provided an arrangement for presorting recyclable materials which includes a first sector-shaped plastic bag having a first opening and a second sector-shaped plastic bag having a second opening. The arrangement also includes a connector, located on at least one of the first sector-shaped plastic bag and the second sector-shaped plastic bag, to connect the first sector-shaped plastic bag to the second sector-shaped plastic bag near the first and second openings such that the second sector-shaped plastic bag can be disconnected from the first sector-shaped plastic bag to allow connection of a third sector-shaped plastic bag (that is identical to the second sector-shaped plastic bag) to the first sector-shaped plastic bag without removal of the first sector-shaped plastic bag. The connector can include a zipperlock connector, an adhesive strip, a hook-and-loop connector, or a plurality of plastic snap fasteners.

According to a second aspect of the invention there is provided an arrangement for presorting recyclable materials which includes a first sector-shaped plastic bag having a first opening, a second sector-shaped plastic bag having a second opening, and a third sector-shaped plastic bag having a third opening. The arrangement also includes a first connector, located on at least one of the first sector-shaped plastic bag and the second sector-shaped plastic bag, to connect the first sector-shaped plastic bag to the second sector-shaped plastic bag near the first and second openings such that the second sector-shaped plastic bag can be disconnected from the first sector-shaped plastic bag to allow connection of a fourth sector-shaped plastic bag (that is identical to the second sector-shaped plastic bag) to the first sector-shaped plastic bag without having to remove the first sector-shaped plastic bag. The arrangement also includes a second connector, located on at least one of the second sector-shaped plastic bag and the third sector-shaped plastic bag, to connect the second sector-shaped plastic bag to the third sector-shaped plastic bag near the second and third openings such that the second sector-shaped plastic bag can be disconnected from the third sector-shaped plastic bag to allow connection of the fourth sector-shaped plastic bag to the third sector-shaped plastic bag without having to remove the third sector-shaped plastic bag.

Other objects, features, and advantages of the invention will be apparent from the following detailed description of preferred embodiments.

BRIEF DESCRIPTION OF THE DRAWINGS

The invention will be described in further detail below with reference to the accompanying drawings, wherein:

FIG. 13(*b*) illustrates a plan view of an arrangement for presorting recyclable materials according to a twelfth preferred embodiment of the invention;

DETAILED DESCRIPTION OF THE PREFERRED EMBODIMENTS

Figure 1:
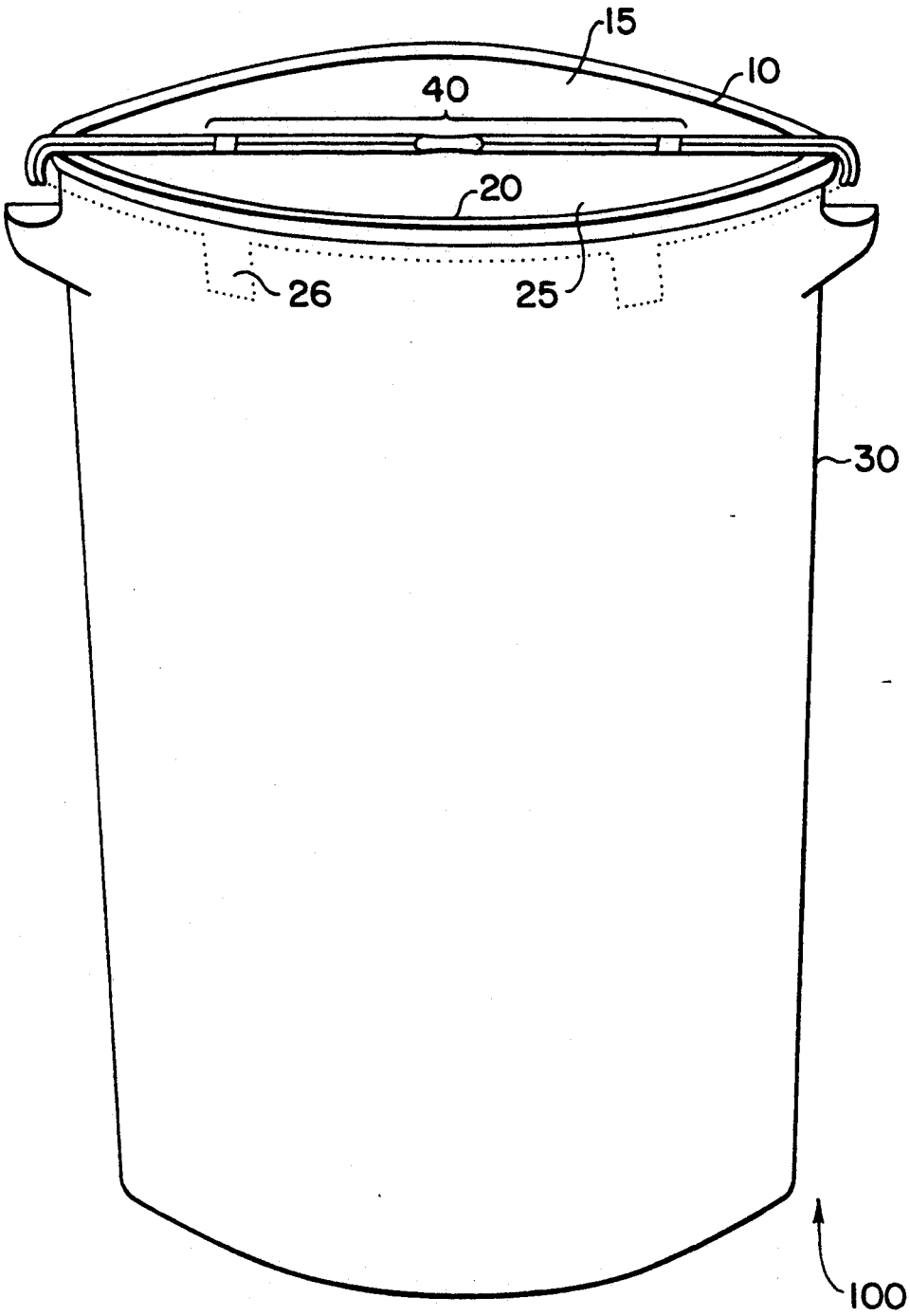
FIG. 1 illustrates a perspective view of an arrangement for presorting recyclable materials according to a first preferred embodiment of the invention.
Figure 2:
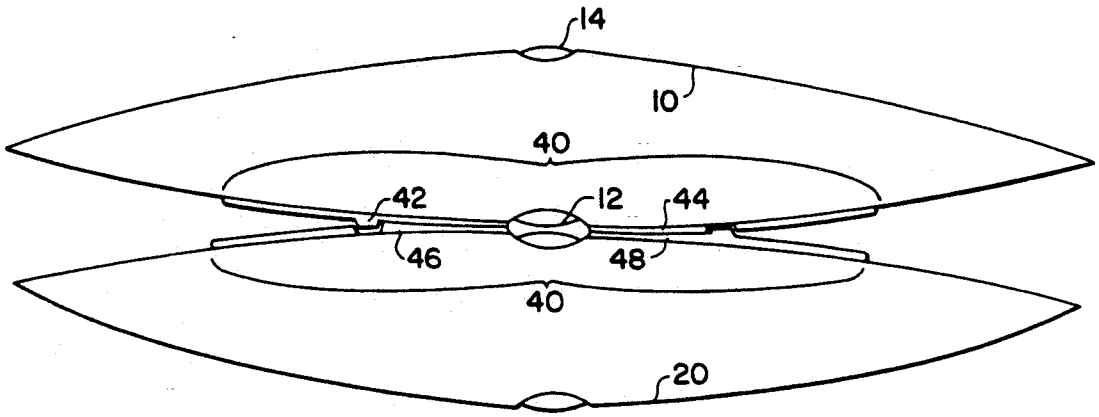
FIG. 2 illustrates a plan view of the first preferred embodiment.
Figure 3:
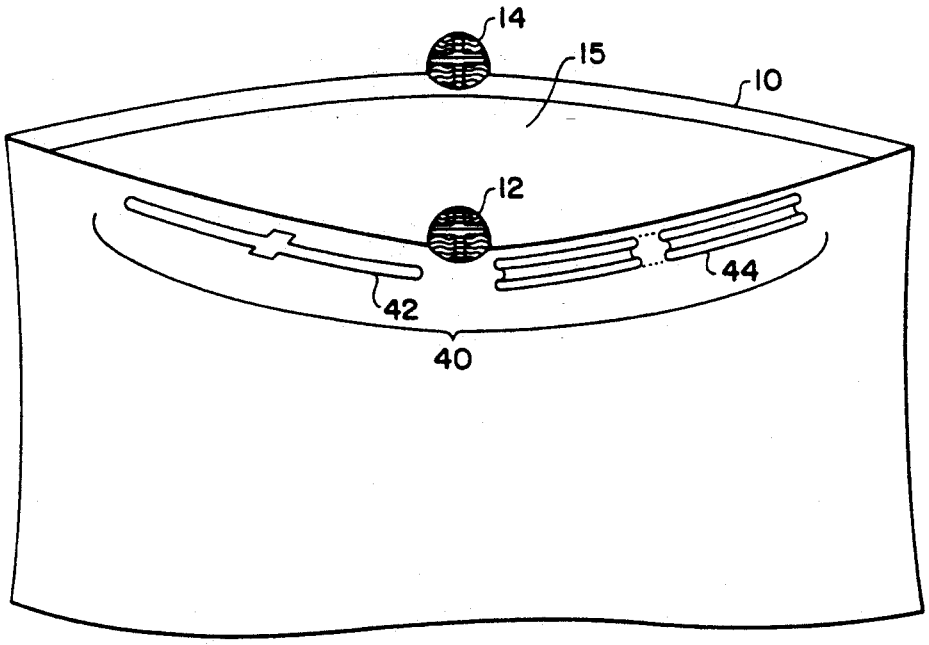
FIG. 3 illustrates a perspective view of a plastic bag of the first preferred embodiment.

FIGS. 1, 2, and 3 illustrate an arrangement 100 for presorting recyclable materials according to a first preferred embodiment of the invention. FIG. 1 illustrates a perspective view of the first preferred embodiment 100.

As illustrated in FIG. 1, the first preferred embodiment 100 includes a first sector-shaped plastic bag 10 having an opening 15 and a second sector-shaped plastic bag 20 having an opening 25. The term "sector-shaped" means that the plastic bags are in the shape of sectors of a circle when viewed from above. The two individual plastic bags are located inside of a standard garbage container 30. The first plastic bag 10 and the second plastic bag 20 are removably connected by a connector 40. The connector 40 allows the bags to be disconnected from one another such that if one individual bag becomes full before the other bag becomes full, the full bag can be taken out of the garbage container 30 while leaving the non-full bag in place in the container. After the full bag has been removed, it can then be replaced with an identical empty bag and connected to the bag that remained in place. Each of the bags forms a compartment for a particular recyclable material.

The bags can be draped over and clamped to the container 30 or they can be secured to the container 30 by adhesive strip 26.

FIG. 2 illustrates a plan view of the first preferred embodiment before it is initially placed in the container 30. As shown in FIG. 2, the connector 40 continuously joins the first plastic bag 10 to the second plastic bag 20 along a large portion of adjacent top edges of the plastic bags.

FIG. 3 illustrates the detailed design of connector 40. Connector 40 includes a protruding edge 42 and an indented edge 44 on the first plastic bag 10. The second plastic bag 20 has an indented edge 46, which is similar to indented edge 44, and which mates with protruding edge 42 of the first plastic bag 10. The second plastic bag 20 also has a protruding edge 48, which is similar to protruding edge 42 of the first plastic bag 10, and which mates with indented edge 44 of the first plastic bag 10. This type of connector is called a zipperlock connector.

When the mating portions of the first and second plastic bags are pressed together, the indented edges catch the protruding edges and the two plastic bags are secured together until intentionally separated.

Each of the plastic bags and the connector is made from plastic, such as polyethylene, preferably from recyclable or biodegradable plastic, using conventional manufacturing techniques. Fabrication of the plastic bags will be described in further detail below in connection with FIGS. 15 through 18.

A draw string (which is concealed by the plastic bag walls in the figures) is provided around the top edge of each bag to close the bag when the bag is full. The drawstrings can be made of plastic or any other material having sufficient strength. Each drawstring is operated by pulling on roughened pull tabs 12 and 14, which are illustrated in FIG. 3. The roughened pull tabs are made of plastic or other material having suitable strength. The pull tabs are roughened to provide friction when pulling on the tabs. The pull tabs will be described in further detail below in connection with FIG. 14. Each bag is labeled.

Figure 4:
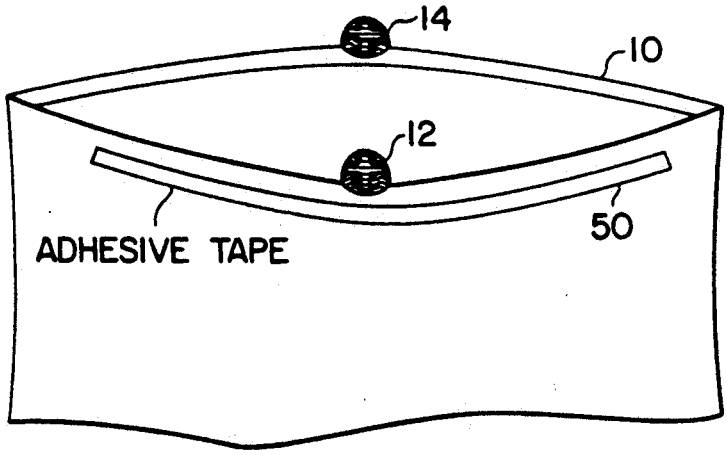
FIG. 4 illustrates a perspective view of an arrangement for presorting recyclable materials according to a second preferred embodiment of the invention.
Figure 5:
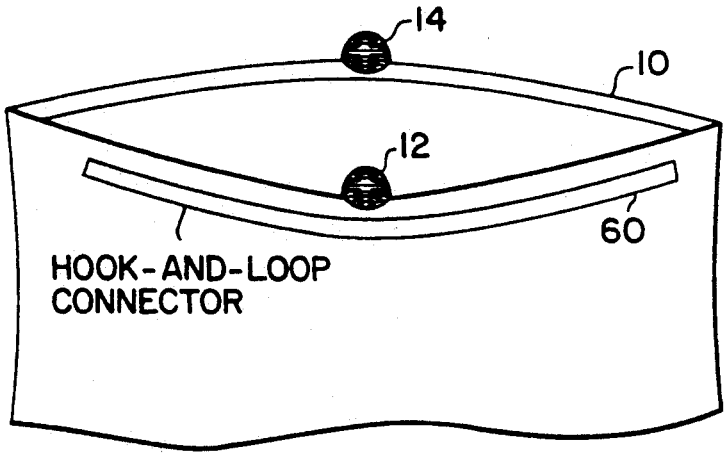
FIG. 5 illustrates a perspective view of an arrangement for presorting recyclable materials according to a third preferred embodiment of the invention.
Figure 6:
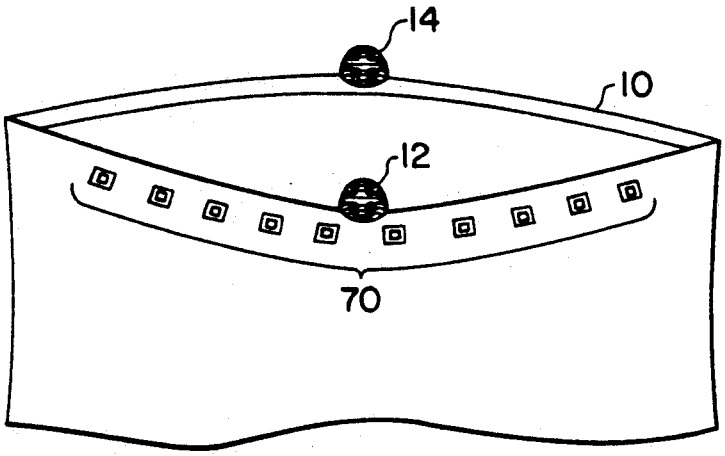
FIG. 6 illustrates a perspective view of an arrangement for presorting recyclable materials according to a fourth preferred embodiment of the invention.

Other connectors can be used to connect the bags together instead of the zipperlock connector. For example, adhesive tape 50 can be used as in the FIG. 4 second preferred embodiment; hook-and-loop connectors (such as VELCRO) 60 can be used as in the FIG. 5 third preferred embodiment; or a plurality of plastic snap fasteners 70 can be used as in the FIG. 6 fourth preferred embodiment. Other connectors can be employed as long as the connector(s) form a substantially continuous closure which joins the top adjacent edges of the bags.

Figure 7:
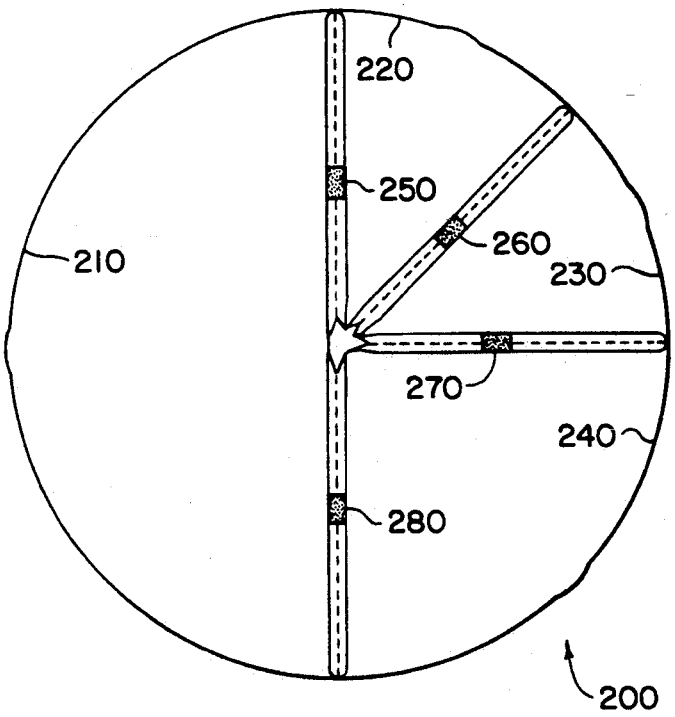
FIG. 7 illustrates a plan view of an arrangement for presorting recyclable materials according to a fifth preferred embodiment of the invention.

FIG. 7 illustrates a fifth preferred embodiment 200 of the invention. The fifth preferred embodiment 200 includes a first sector-shaped plastic bag 210, a second sector-shaped plastic bag 220, a third sector-shaped plastic bag 230, and a fourth sector-shaped plastic bag 240. The bags are connected to each other by connectors 250, 260, 270, and 280. Bag 210 is in the shape of a half-circle, bag 240 is in the shape of a quarter-circle, and bags 220 and 230 are in the shape of an eighth-circle.

The different size bags can be color coded. For example, eighth-circle bags can be color coded by providing the eighth-circle bags with a red draw string, quarter-circle bags can be color coded by providing the quarter-circle bags with a yellow draw string, and half-circle bags can be color coded by providing the half-circle bags with a blue drawstring.

Different recyclable materials will accumulate at a particular site at different rates. The provision of different size bags for storing different recyclable materials allows a large bag to be used for a recyclable material which is bulky and/or which accumulates at a fast rate. On the other hand, recyclable materials which are small and/or which do not accumulate quickly can be collected smaller size bags.

Each of the individual bags is removably connected to adjacent bags such that when an individual bag becomes full that bag can be replaced with an empty identically sized bag without having to remove and dispose of all of the bags. For example, if bag 230 in FIG. 7 becomes full when bags 210, 220, and 240 are only partially filled, bag 230 can be removed by disconnecting connectors 260 and 270 and removing bag 230. Then, bag 230 can be replaced with an empty identical eighth-circle bag and connectors 260 and 270 reconnected. Thus, the invention provides an arrangement wherein only full bags need be replaced.

Another important feature of the invention can be appreciated from FIG. 7. As shown in FIG. 7, there is no appreciable space between the openings of adjacent bags. More specifically, adjacent top edges of adjacent bags are continuously joined to prevent debris from becoming lodged in-between the bags.

Figure 8:
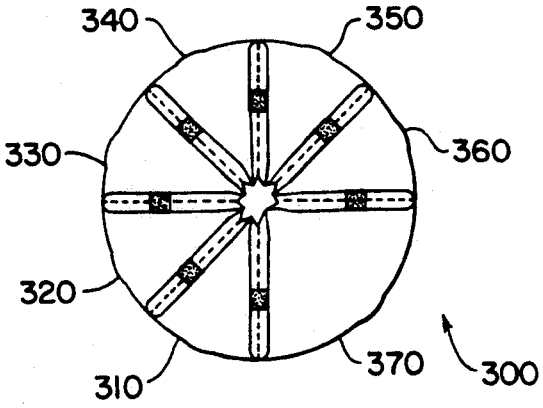
FIG. 8 illustrates a plan view of an arrangement for presorting recyclable materials according to a sixth preferred embodiment of the invention.

FIGS. 8-13 illustrate additional embodiments of the invention which demonstrate how the invention provides for customization to the particular needs of a user. In the invention, the size of storage compartments can be changed to suit the needs of a particular user at a particular time. For example, if a user decides to presort seven different recyclable materials, the arrangement of the fifth preferred embodiment illustrated in FIG. 7 would be unsuitable because the fifth preferred embodiment only provides four storage compartments. In this event, the fifth preferred embodiment 200 of FIG. 7 can be converted into the sixth preferred embodiment 300 illustrated in FIG. 8 by replacing half-circle bag 210 of the FIG. 7 preferred embodiment with four one-eighth circle bags 310, 320, 330, and 340, as shown in FIG. 8.

Figure 9:
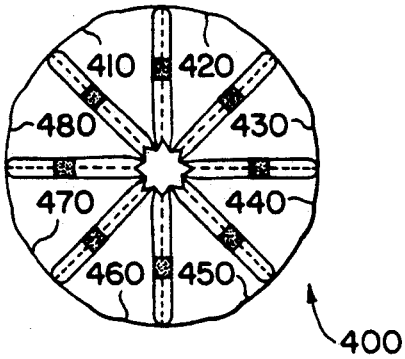
FIG. 9 illustrates a plan view of an arrangement for presorting recyclable materials according to a seventh preferred embodiment of the invention.

If eight compartments are required, the sixth preferred embodiment of FIG. 8 can be converted into the seventh preferred embodiment 400, illustrated in FIG. 9, by replacing the one-quarter circle bag 370 of FIG. 8 with two one-eighth circle bags 440 and 450, as shown in FIG. 9.

Figure 10:
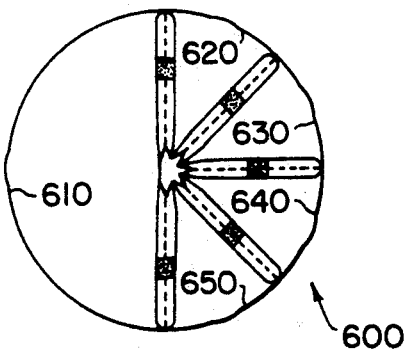
FIG. 10 illustrates a plan view of an arrangement for presorting recyclable materials according to an eighth preferred embodiment of the invention.
Figure 12:
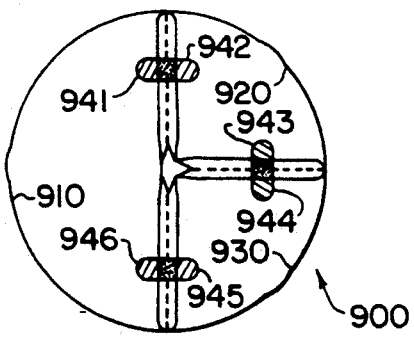
FIG. 12 illustrates a plan view of an arrangement for presorting recyclable materials according to a tenth preferred embodiment of the invention.
Figure 11:
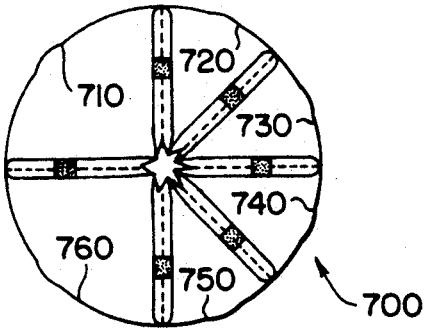
FIG. 11 illustrates a plan view of an arrangement for presorting recyclable materials according to a ninth preferred embodiment of the invention.
Figure 13A:
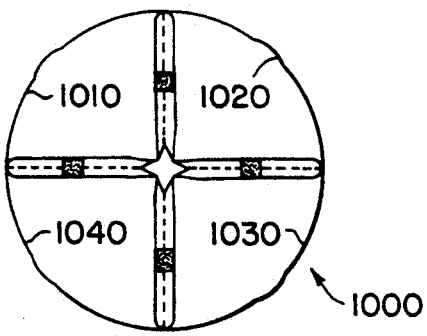
FIG. 13(*a*) illustrates a plan view of an arrangement for presorting recyclable materials according to an eleventh preferred embodiment of the invention.
Figure 13B:
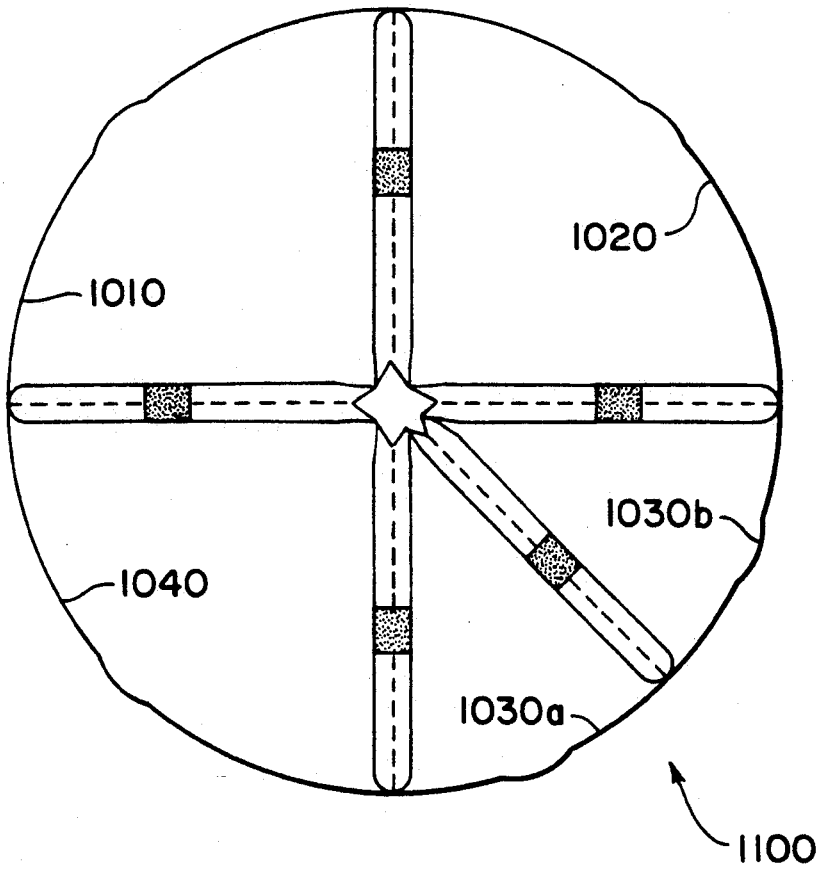

FIGS. 10, 11, 12, and 13 illustrate examples of additional embodiments. FIG. 10 illustrates an eighth preferred embodiment which includes a half-circle bag 610 and four one-eighth circle bags 620, 630, 640 and 650. FIG. 11 illustrates a ninth preferred embodiment which includes two quarter-circle bags 710 and 760 and four one-eighth circle bags 720, 730, 740, and 750. FIG. 12 illustrates a tenth preferred embodiment which includes a half-circle bag 910 and two quarter-circle bags 920 and 930. In the FIG. 12 embodiment, the bags include separation tabs 941 to 946 in the vicinity of where the bags are joined to each other to make separation of the bags by the user easier when a bag must be replaced. The separation tabs give the user something to pull on to separate the bags. FIG. 13(*a*) illustrates an eleventh preferred embodiment which includes four quarter-circle bags 1010, 1020, 1030, and 1040. FIG. 13(*b*) illustrates a twelfth preferred embodiment which includes three quarter-circle bags 1010, 1020, and 1040 and two eighth-circle bags 1030*a* and 1030*b*.

Figure 14:
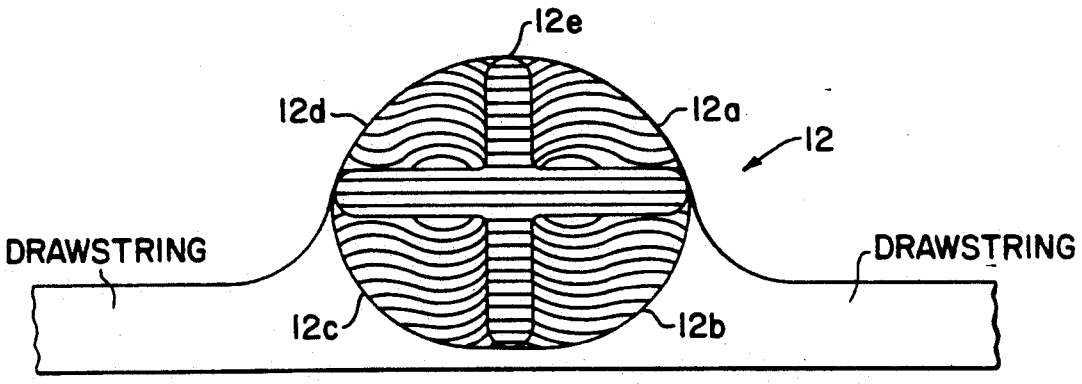
FIG. 14 illustrates a close-up view of a drawstring pull tab.

FIG. 14 illustrates a close-up view of roughened pull tab 12. Roughened pull tab 12 is connected to the draw string. Roughened pull tab 12 includes four recessed areas 12*a*, 12*b*, 12*c*, and 12*d* which are roughened with a series of protruding waves. Roughened pull tab 12 also includes a ridge section 12*e* in the shape of a cross which is also roughened by protruding waves. The ridge 12*e* is greater in height than recessed portions 12*a*, 12*b*, 12*c*, and 12*d* to maximize the friction between the roughened pull tab 12 and a user's fingers.

Figure 15:
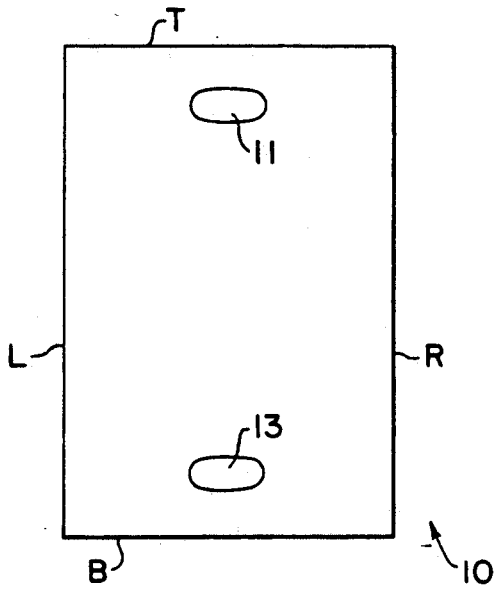
FIGS. 15 through 18 illustrate how the bag illustrated in FIG. 3 is made.
Figure 17:
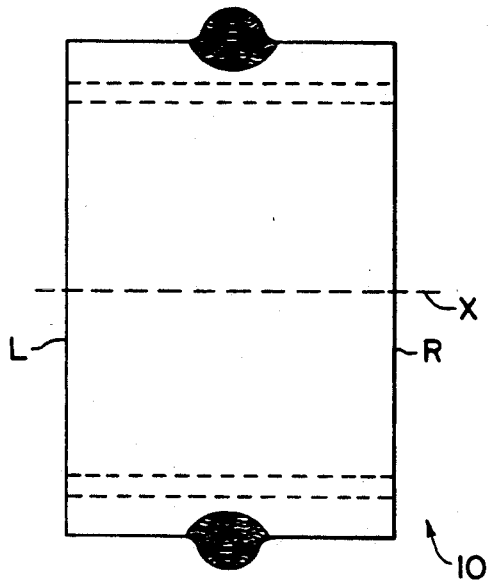
Figure 16:
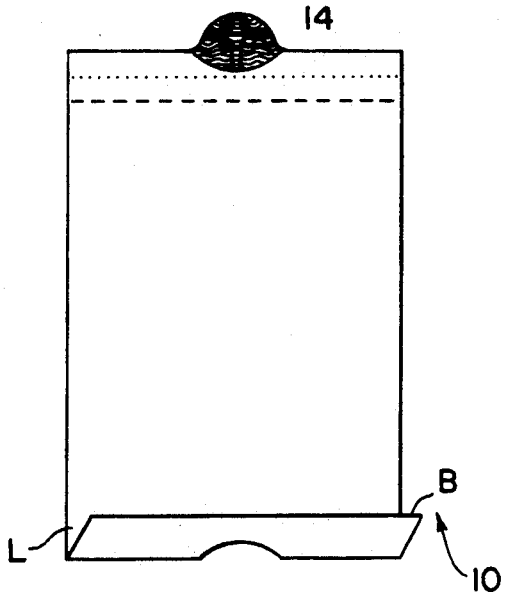
Figure 18:
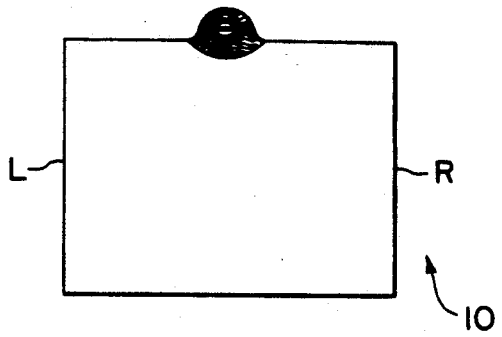

FIGS. 15 through 18 illustrate how the bag 10 of FIG. 3 is made. First, two oval holes 11 and 13 for the draw string pull tabs are formed in a flat piece of plastic sheet material, as illustrated in FIG. 15. The bottom edge B is then folded over to form a crease C, as illustrated in FIG. 16. The drawstring is then inserted into the crease C and the edge B is heat sealed to the sheet material. The same process is used for the top edge T. FIG. 16 illustrates pull tab 14 after the draw string and pull tab has been inserted in the top crease and the edge T has been heat sealed. The sheet material is then folded along line X in FIG. 17. After the sheet material is folded along line X, the left edge L and the right edge R are heat sealed to arrive at the arrangement illustrated in FIG. 18. Finally, the connector(s) (not shown in FIGS. 15 through 18) are attached to the bag by, for example, heat sealing.

Although the invention has been described above with respect to certain specific embodiments, the scope of the invention is not limited to the specific embodiments disclosed. Other designs within the spirit and scope of the invention will be apparent to those skilled in the field after receiving the above teachings. For example, the bags need not be partially circular, that is sector-shaped, in cross section but rather can be in other shapes, such as polygon-shaped. The invention, therefore, is defined by the following claims.

What is claimed is:

1. An arrangement for presorting recyclable materials, said arrangement comprising:

a first sector-shaped plastic bag having a first opening;

a second sector-shaped plastic bag having a second opening; and a connector, located on and integral with at least one of said first sector-shaped plastic bag and said second sector-shaped plastic bag, to connect said first sector-shaped plastic bag to said second sector-shaped plastic bag at said first and second openings such that said second sector-shaped plastic bag can be disconnected from said first sector-shaped plastic bag to allow connection of a third sector-shaped plastic bag, which is identical to said second sector-shaped plastic bag, to said first sector-shaped plastic bag without removal of said first sector-shaped plastic bag from its location in said arrangement.

2. An arrangement as set forth in claim 1, wherein said first sector-shaped plastic bag includes adhesion to connect said first sector-shaped plastic bag to a container.

3. An arrangement as set forth in claim 1, wherein said first sector-shaped plastic bag includes a first draw string, and wherein said second sector-shaped plastic bag includes a second string that is different in color than a color of said first draw string.

4. An arrangement as set forth in claim 1, wherein said first sector-shaped plastic bag includes a draw string which has a roughened pull tab.

5. An arrangement as set forth in claim 1, wherein said connector continuously connects said first sector-shaped plastic bag to said second sector-shaped plastic bag along substantially the entire portion of said first and second openings that said first sector-shaped plastic bag is adjacent to said second sector-shaped plastic bag.

6. An arrangement as set forth in claim 1, wherein said connector includes a protruding edge and an indented edge that catches said protruding edge.

7. An arrangement as set forth in claim 1, wherein said connector includes an adhesive strip.

8. An arrangement as set forth in claim 1, wherein said connector includes a hook-and-loop connector.

9. An arrangement as set forth in claim 1, wherein said connector includes a plurality of plastic snap fasteners.

10. An arrangement as set forth in claim 1, wherein said first sector-shaped plastic bag is in the shape of a half-circle.

11. An arrangement as set forth in claim 1, wherein said first sector-shaped plastic bag is in the shape of a quarter-circle.

12. An arrangement as set forth in claim 1, wherein said first sector-shaped plastic bag is in the shape of an eighth-circle.

13. An arrangement as set forth in claim 1, wherein said first sector-shaped plastic bag and said second sector-shaped plastic bag include separation tabs in the vicinity of where said bags are connected to each other to assist in separation of the bags.

14. An arrangement for presorting recyclable materials, said arrangement comprising:

a first sector-shaped plastic bag having a first opening;

a second sector-shaped plastic bag having a second opening;

a third sector-shaped plastic bag having a third opening;

a first connector, located on and integral with at least one of said first sector-shaped plastic bag and said second sector-shaped plastic bag, to connect said first sector-shaped plastic bag to said second sector-shaped plastic bag at said first and second openings such that said second sector-shaped plastic bag can be disconnected from said first sector-shaped plastic bag to allow connection of a fourth sector-shaped plastic bag, which is identical to said second sector-shaped plastic bag, to said first sector-shaped plastic bag without having to remove said first sector-shaped plastic bag from its location in said arrangement; and a second connector, located on and integral with at least one of said second sector-shaped plastic bag and said third sector-shaped plastic bag, to connect said second sector-shaped plastic bag to said third sector-shaped plastic bag at said second and third openings such that said second sector-shaped plastic bag can be disconnected from said third sector-shaped plastic bag to allow connection of said fourth sector-shaped plastic bag to said third sector-shaped plastic bag without having to remove said third sector-shaped plastic bag from its location in said arrangement.

15. An arrangement as set forth in claim 14, wherein said first sector-shaped plastic bag includes adhesive to connect said first sector-shaped plastic bag to a container.

16. An arrangement as set forth in claim 14, wherein said first sector-shaped plastic bag includes a first draw string, said second sector-shaped plastic bag includes a second draw string, and said third sector-shaped plastic bag includes a third draw string, and wherein said first, second, and third draw strings are different in color from one another.

17. An arrangement as set forth in claim 14, wherein said first sector-shaped plastic bag includes a draw string which has a roughened pull tab.

18. An arrangement as set forth in claim 14, wherein:

said first connector continuously connects said first sector-shaped plastic bag to said second sector-shaped plastic bag along substantially the entire portion of said first and second openings that said first sector-shaped plastic bag is adjacent to said second sector-shaped plastic bag; and said second connector continuously connects said second sector-shaped plastic bag to said third sector-shaped plastic bag along substantially the entire portion of said second and third openings that said second sector-shaped plastic bag is adjacent to said third sector-shaped plastic bag.

19. An arrangement as set forth in claim 14, wherein said first connector includes a protruding edge and an indented edge that catches said protruding edge.

20. An arrangement as set forth in claim 14, wherein said first connector includes an adhesive strip.

21. An arrangement as set forth in claim 14, wherein said first connector includes a hook-and-loop connector.

22. An arrangement as set forth in claim 14, wherein said first connector includes a plurality of plastic snap fasteners.

23. An arrangement as set forth in claim 14, wherein said second sector-shaped plastic bag is in the shape of a half-circle.

24. An arrangement as set forth in claim 14, wherein said second sector-shaped plastic bag is in the shape of a quarter-circle.

25. An arrangement as set forth in claim 14, wherein said second sector-shaped plastic bag is in the shape of an eighth-circle.

26. An arrangement as set forth in claim 14, wherein said first sector-shaped plastic bag and said second sector-shaped plastic bag include separation tabs in the vicinity of where said first and second sector-shaped plastic bag are connected to each other to assist in separation of said first and second sector-shaped plastic bags.

27. An arrangement for presorting recyclable materials, said arrangement comprising:

a first plastic bag having a first opening;

a second plastic bag having a second opening; and a connector, located on and integral with at least one of said first plastic bag and said second plastic bag, to connect said first plastic bag to said second plastic bag at said first and second openings such that said second plastic bag can be disconnected from said first plastic bag to allow connection of a third plastic bag, which is identical to said second plastic bag, to said first plastic bag without removal of said first plastic bag from its location in said arrangement.

28. An arrangement as set forth in claim 27, wherein said connector continuously connects said first plastic bag to said second plastic bag along substantially the entire portion of said first and second openings that said first plastic bag is adjacent to said second plastic bag.

29. An arrangement for presorting recyclable materials, said arrangement comprising:

a first plastic bag having a first opening;

a second plastic bag having a second opening;

a third plastic bag having a third opening;

a first connector, located on and integral with at least one of said first plastic bag and said second plastic bag, to connect said first plastic bag to said second plastic bag at said first and second openings such that said second plastic bag can be disconnected from said first plastic bag to allow connection of a fourth plastic bag, which is identical to said second plastic bag, to said first plastic bag without having to remove said first plastic bag from its location in said arrangement; and a second connector, located on and integral with at least one of said second plastic bag and said third plastic bag, to connect said second plastic bag to said third plastic bag at said second and third openings such that said second plastic bag can be disconnected from said third plastic bag to allow connection of said fourth plastic bag to said third plastic bag without having to remove said third plastic bag from its location in said arrangement.

30. An arrangement as set forth in claim 29, wherein:

said first connector continuously connects said first plastic bag to said second plastic bag along substantially the entire portion of said first and second openings that said first plastic bag is adjacent to said second plastic bag; and said second connector continuously connects said second plastic bag to said third plastic bag along substantially the entire portion of said second and third openings that said second plastic bag is adjacent to said third plastic bag.

31. An arrangement for presorting recyclable materials, said arrangement comprising:

a first plastic bag having a first opening;

a second plastic bag having a second opening; and a connector, located on and integral with at least one of said plastic bag and said second plastic bag, to connect said first plastic bag to said second plastic bag at said first and second openings such that said second plastic bag can be disconnected from said first plastic bag to allow connection of at least two additional plastic bags in place of said second plastic bag to said first plastic bag without removal of said first plastic bag from its location in said arrangement, said at least two additional plastic bags being inserted in place of said second plastic bag at the same time.

32. An arrangement for presorting recyclable materials, said arrangement comprising:

a first plastic bag having a first opening;

a second plastic bag having a second opening;

a third plastic bag having a third opening;

a first connector, located on and integral with at least one of said first plastic bag and said second plastic bag, to connect said first plastic bag to said second plastic bag at said first and second openings such that said second plastic bag can be disconnected from said first plastic bag to allow connection of at least two additional plastic bags in place of said second plastic bag without having to remove said first plastic bag from its location in said arrangement, said at least two additional plastic bags being inserted in place of said second plastic bag at the same time; and a second connector, located on and integral with at least one of said second plastic bag and said third plastic bag, to connect said second plastic bag to said third plastic bag at said second and third openings such that said second plastic bag can be disconnected from said third plastic bag to allow connection of said at least two additional plastic bags in place of said second plastic bag without having to remove said third plastic bag from its location in said arrangement.

* * * * *